US011699409B2

(12) United States Patent
Deng et al.

(10) Patent No.: US 11,699,409 B2
(45) Date of Patent: Jul. 11, 2023

(54) DISPLAY DRIVING CIRCUIT, METHOD FOR DRIVING TIMING CONTROL CIRCUIT, AND DISPLAY DEVICE

(71) Applicants: Chongqing BOE Optoelectronics Technology Co., Ltd., Chongqing (CN); BOE Technology Group Co., Ltd., Beijing (CN)

(72) Inventors: Ming Deng, Beijing (CN); Jiantao Liu, Beijing (CN); Zhihua Sun, Beijing (CN); Wenliang Liu, Beijing (CN)

(73) Assignees: Chongqing BOE Optoelectronics Technology Co., Ltd., Chongqing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/535,967

(22) Filed: Nov. 26, 2021

(65) Prior Publication Data

US 2022/0270560 A1 Aug. 25, 2022

(30) Foreign Application Priority Data

Feb. 22, 2021 (CN) ..... 202110198356.0

(51) Int. Cl.
*G09G 3/36* (2006.01)
*G09G 3/3225* (2016.01)

(52) U.S. Cl.
CPC ..... *G09G 3/3648* (2013.01); *G09G 3/3225* (2013.01); *G09G 2310/06* (2013.01); *G09G 2310/08* (2013.01)

(58) Field of Classification Search
CPC .. G09G 3/3648; G09G 3/3225; G09G 3/3275; G09G 3/3607; G09G 3/2007;
(Continued)

(56) References Cited

U.S. PATENT DOCUMENTS

2006/0007207 A1* 1/2006 Kawaguchi ..... G09G 3/3651 345/204
2008/0018569 A1 1/2008 Sung et al.
(Continued)

FOREIGN PATENT DOCUMENTS

CN 110021274 A 7/2019
CN 110444173 A 11/2019
(Continued)

OTHER PUBLICATIONS

CN 202110198356.0 first office action.

*Primary Examiner* — David Tung
(74) *Attorney, Agent, or Firm* — IPro, PLLC

(57) ABSTRACT

A display driving circuit is provided. The display driving circuit includes a source driver, a temperature detecting circuit, and a timing control circuit, wherein the temperature detecting circuit is connected to the timing control circuit, and is configured to detect a temperature of the source driver; and the timing control circuit is further connected to the source driver, and is configured to output a source signal to the source driver based on the temperature of the source driver; wherein a magnitude of a voltage of the source signal is negatively related to the temperature of the source driver.

18 Claims, 5 Drawing Sheets

(58) Field of Classification Search
CPC .. G09G 3/36; G09G 2310/06; G09G 2310/08; G09G 2310/027; G09G 2320/041; G09G 2320/0646; G09G 2360/16
See application file for complete search history.

(56) References Cited

U.S. PATENT DOCUMENTS

| | | | | |
|---|---|---|---|---|
| 2012/0086713 | A1 | 4/2012 | Cho et al. | |
| 2014/0111499 | A1* | 4/2014 | Jang | H01L 31/068 345/212 |
| 2016/0267861 | A1* | 9/2016 | Nakahara | G09G 3/3696 |
| 2017/0092222 | A1* | 3/2017 | Kim | G09G 3/2092 |
| 2018/0151127 | A1* | 5/2018 | Won | G09G 3/3275 |
| 2019/0339564 | A1 | 11/2019 | Wu et al. | |
| 2019/0392777 | A1* | 12/2019 | Kim | G09G 3/3688 |

FOREIGN PATENT DOCUMENTS

| | | | |
|---|---|---|---|
| CN | 112365832 | A | 2/2021 |
| JP | 2011112970 | A | 6/2011 |
| KR | 20080008070 | A | 1/2008 |
| KR | 20090091960 | A | 8/2009 |

* cited by examiner

DISPLAY DRIVING CIRCUIT, METHOD FOR DRIVING TIMING CONTROL CIRCUIT, AND DISPLAY DEVICE

CROSS-REFERENCE TO RELATED APPLICATION

The present application claims priority to Chinese Patent Application No. 202110198356.0, filed on Feb. 22, 2021 and entitled "DISPLAY DRIVING CIRCUIT, METHOD FOR CONTROLLING SAME, AND DISPLAY DEVICE", the entire contents of which are incorporated herein by reference.

TECHNICAL FIELD

The present disclosure relates to the field of display technologies, and in particular, relates to a display driving circuit, a method for driving a timing control circuit, and a display device.

BACKGROUND

With the advancement of display technology, the size of a display panel included in a display device is becoming larger and larger, and the demand for higher resolution and refresh rate of display panels is increasing.

It should be noted that information disclosed in the background section above is merely used to enhance understanding of the background of the present disclosure, and thus may include information that does not constitute the related art known to those of ordinary skill in the art.

SUMMARY

According to a first aspect of the present disclosure, a display driving circuit is provided including: a source driver, a temperature detecting circuit, and a timing control circuit;

wherein the temperature detecting circuit is connected to the timing control circuit, and is configured to detect a temperature of the source driver;

the timing control circuit is further connected to the source driver, and is configured to output a source signal to the source driver based on the temperature of the source driver;

a magnitude of a voltage of the source signal is negatively related to the temperature of the source driver.

According to an implementation of the present disclosure, the timing control circuit includes a control sub-circuit and a timing controller; the timing controller stores a first mapping relationship between gray scales and voltages of the source signal;

the control sub-circuit is respectively connected to the temperature detecting circuit and the timing controller, and the timing controller is further connected to the source driver;

the control sub-circuit is configured to control the timing controller to output the source signal based on the first mapping relationship when the temperature of the source driver is less than a temperature threshold, and to control the timing controller to output the source signal based on a second mapping relationship between the gray scales and the voltages of the source signal when the temperature of the source driver is greater than or equal to the temperature threshold;

wherein, each voltage of the source signal in the second mapping relationship is determined based on a product of a corresponding voltage of the source signal in the first mapping relationship and a gain coefficient, the gain coefficient being less than 1.

According to an implementation of the present disclosure, each voltage of the source signal in the second mapping relationship is equal to the product of a corresponding voltage of the source signal in the first mapping relationship and the gain coefficient.

According to an implementation of the present disclosure, the timing controller further stores the second mapping relationship.

According to an implementation of the present disclosure, the timing controller further stores the gain coefficient;

the control sub-circuit is further configured to adjust the voltages of the source signal in the first mapping relationship based on the gain coefficient to obtain the second mapping relationship when the temperature of the source driver is greater than or equal to the temperature threshold.

According to an implementation of the present disclosure, the control sub-circuit is further configured to:

determine a target mapping relationship, based on which the timing controller outputs the source signal when an image of a second frame is displayed, in the process of displaying an image of a first frame;

wherein the target mapping relationship is any of the first mapping relationship and the second mapping relationship, the first frame and the second frame are adjacent, and the first frame precedes the second frame.

According to an implementation of the present disclosure, the control sub-circuit is further configured to control the timing controller to continuously output the source signal based on the second mapping relationship during a target time period when the temperature of the source driver is greater than or equal to the temperature threshold.

According to an implementation of the present disclosure, the control sub-circuit is disposed inside the timing controller;

wherein the timing controller has a signal interface, and the temperature detecting circuit is connected to the control sub-circuit through the signal interface.

According to an implementation of the present disclosure, the control sub-circuit includes a micro controller unit MCU.

According to an implementation of the present disclosure, the temperature detecting circuit includes a temperature sensor and a conversion sub-circuit, and the conversion sub-circuit is respectively connected to the temperature sensor and the control sub-circuit;

the temperature sensor is configured to detect the temperature of the source driver; and the conversion sub-circuit is configured to output a first signal to the control sub-circuit when the temperature of the source driver is greater than or equal to the temperature threshold, and output a second signal to the control sub-circuit when the temperature of the source driver is less than the temperature threshold; wherein the control sub-circuit, in response to the first signal, controls the timing controller to output the source signal based on the second mapping relationship; and the control sub-circuit, in response to the second signal, controls the timing controller to output the source signal based on the first mapping relationship.

According to an implementation of the present disclosure, the temperature sensor is packaged within the source driver; and the source driver has a temperature signal pin, and both the temperature sensor and the control sub-circuit are connected to the temperature signal pin.

According to an implementation of the present disclosure, the temperature sensor is disposed on a surface of a package housing, and the package housing is configured to package the source driver.

According to an implementation of the present disclosure, the conversion sub-circuit includes an analog to digital converter.

According to a second aspect of the present disclosure, a method for driving a timing control circuit is provided. The method includes:

obtaining a temperature of a source driver through a temperature detecting circuit; and outputting a source signal to the source driver based on the temperature of the source driver;

wherein, a magnitude of a voltage of the source signal is negatively related to the temperature of the source driver.

According to an implementation of the present disclosure, the timing control circuit includes a control sub-circuit and a timing controller; the timing controller stores a first mapping relationship between gray scales and voltages of the source signal; outputting the source signal to the source driver based on the temperature of the source driver includes:

controlling the timing controller to output the source signal by the control sub-circuit based on the first mapping relationship when the temperature of the source driver is less than a temperature threshold;

controlling the timing controller to output the source signal by the control sub-circuit based on a second mapping relationship between the gray scales and the voltages of the source signal when the temperature of the source driver is greater than or equal to the temperature threshold;

wherein, each voltage of the source signal in the second mapping relationship is determined based on a product of a corresponding voltage of the source signal in the first mapping relationship and a gain coefficient, the gain coefficient being less than 1.

According to an implementation of the present disclosure, each voltage of the source signal in the second mapping relationship is equal to the product of a corresponding voltage of the source signal in the first mapping relationship and the gain coefficient.

According to an implementation of the present disclosure, the timing controller further stores the second mapping relationship.

According to an implementation of the present disclosure, the timing controller further stores the gain coefficient; before controlling the timing controller to output the source signal by the control sub-circuit based on the second mapping relationship between the gray scales and the voltages of the source signal, the method further includes:

adjusting the voltage of the source signal in the first mapping relationship by the control sub-circuit based on the gain coefficient to obtain the second mapping relationship.

According to a third aspect of the present disclosure, a display device is provided. The display device includes a display panel and a display driving circuit, wherein the display driving circuit is connected to the display panel, and is configured to drive the display panel to display;

wherein the display driving circuit includes a source driver, a temperature detecting circuit, and a timing control circuit;

the temperature detecting circuit is connected to the timing control circuit, and is configured to detect a temperature of the source driver;

the timing control circuit is further connected to the source driver, and is configured to output a source signal to the source driver based on the temperature of the source driver;

a magnitude of a voltage of the source signal is negatively related to the temperature of the source driver.

It should be understood that both the foregoing general description and the following detailed description are merely exemplary and explanatory, and are not intended to limit the present disclosure.

BRIEF DESCRIPTION OF THE DRAWINGS

The accompanying drawings herein are incorporated in and constitute a part of this specification; illustrate the embodiments consistent with the present disclosure, and are used to explain the principles of the present disclosure in conjunction with the specification. Apparently, the accompanying drawings in the following description show merely some embodiments of the present disclosure, and persons of ordinary skill in the art may still derive other accompanying drawings from these accompanying drawings without creative efforts.

DETAILED DESCRIPTION

Figure 1:
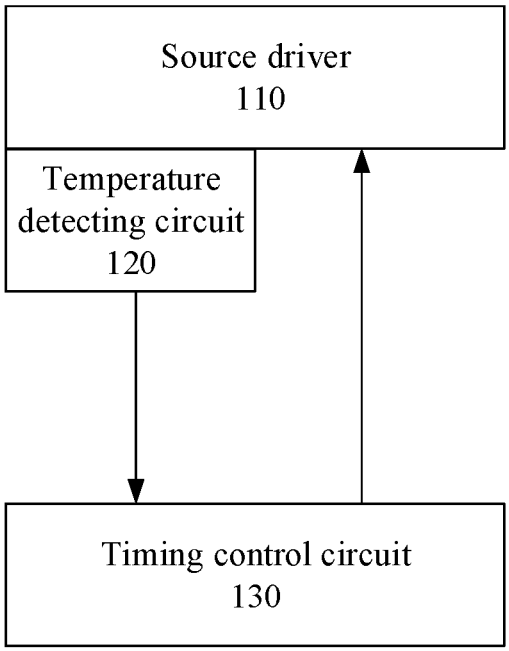
FIG. 1 is a schematic structural diagram of a display driving circuit according to an embodiment of the present disclosure.

Exemplary implementations are hereinafter described more fully with reference to the accompanying drawings. However, the exemplary implementations can be implemented in various forms, and shall not be constructed as limited to the implementations set forth herein. On the contrary, provision of these implementations may enable the present disclosure to be more comprehensive and complete, and thereby conveying the concept of the exemplary implementations to those skilled in the art. The same reference signs in the drawings may indicate the same or similar structures, and thus their detailed descriptions are omitted.

Although relative terms such as "up" and "down" are adopted in this specification to describe the relative relationship of one component to another represented by a reference sign, these terms are adopted in this specification only for convenience, for example, based on the direction of the example described in the accompanying drawings. It can be understood that if the device shown by the reference sign is flipped to make it upside down, the component described as being "up" may become the component described as being "down." When a structure is "on" other structures, it may mean that a structure is integrally formed on other structures, or that a structure is "directly" provided on other structures, or that a structure is "indirectly" provided on other structures via another structure.

The terms "a," "one," "the" are adopted to indicate the existence of one or more elements, components or the like; and the terms "include" and "comprise" are adopted to indicate open-ended inclusion and to mean that additional elements, components or the like may exist besides the listed elements, components or the like. The terms "first" and "second" and the like are used merely as labels, and are not intended to limit the number of objects.

As the size of a display panel included in a display device is increasing and the demand for the display panel on a resolution rate and a refresh rate is increasing, the power consumption when the display panel operates is correspondingly increasing. The test shows that the power consumption of a source driver used to drive the display panel display may also increase dramatically when the display panel displays images at high power consumption. The dramatically increased power consumption of the source driver further results in an increase in a temperature of the source driver, and the source driver can be damaged when the temperature of the source driver is greater than a threshold temperature. The threshold temperature can be a maximum temperature at which the source driver is capable of operating normally.

The exemplary embodiments of the present disclosure provide a display driving circuit, and in the display driving circuit, a source driver is less vulnerable to damage, and has a longer lifetime. As shown in FIG. 1, the display driving circuit includes a source driver 110, a temperature detecting circuit 120, and a timing control circuit 130.

The temperature detecting circuit 120 is connected to the timing control circuit 130, and the timing control circuit 130 is further connected to the source driver 110. The temperature detecting circuit 120 is configured to detect a temperature of the source driver 110. The timing control circuit 130 is configured to output a source signal to the source driver 120 based on the temperature of the source driver 120. For example, referring to FIG. 1, the temperature detecting circuit 120 can be contacted with the source driver 110 to reliably detect the temperature of the source driver 110.

In the embodiments of the present disclosure, a magnitude of a voltage of the source signal is negatively related to the temperature of the source driver 120. That is, in the case that the temperature of the source driver 120 is greater, the voltage of the source signal output by the timing control circuit 130 to the source driver 120 is less. On the contrary, in the case that the temperature of the source driver 120 is less, the voltage of the source signal output by the timing control circuit 130 to the source driver 120 is greater.

Because the source driver 120 is operating in response to a less voltage, compared with in response to a greater voltage, the temperature of the source driver 120 can be lower, that is, the temperature of the source driver 120 is positively related to the voltage of the source signal output by the timing control circuit 130, when the temperature of the source driver 120 is greater, the timing control circuit 130 outputs a source signal with a less voltage to the source driver 120, thereby correspondingly decreasing the temperature of the source driver 120, and preventing the source driver 120 from being damaged by a greater temperature. In addition, the power consumption of the timing control circuit 130 may further be reduced, and the power consumption when the display panel operates is further reduced. Thus, the display panel can be ensured to have a longer lifetime.

In summary, the embodiments of the present disclosure provide a display driving circuit. In the display driving circuit, the timing control circuit can output the source signal to the source driver based on the temperature of the source driver detected by the temperature detecting circuit, and the voltage of the output source signal is negatively related to the temperature of the source driver. As the temperature of the source driver is positively related to the voltage of the source signal output by the timing control circuit 130, by setting the timing control circuit to output the source signal with a less voltage to the source driver when the temperature of the source driver is greater, the temperature of the source driver can be reduced. As such, the problem of the source driver being damaged by high temperature can be solved.

Portions of the display driving circuit provided in the embodiments of the present disclosure are explained in detail as follows.

Optionally, the display panel generally includes a plurality of pixels, each of the plurality of pixels includes a pixel circuit and a light emitting element that are coupled to each other. The pixel circuit can be respectively connected to a gate signal terminal, a data signal terminal, and the light emitting element, and the pixel circuit may drive the light emitting element to luminesce based on a gate control signal (e.g., a scan signal) provided by the gate signal terminal and a data signal provided by the data signal terminal.

On this basis, the source driver 110 in the embodiments of the present disclosure may further be connected to the data signal terminal that is connected the pixel circuit, and the source driver 110 may output the data signal to the data signal terminal based on the source signal output by the timing control circuit 130.

The source signal output to the source driver 110 by the timing control circuit 130 (i.e., the source signal acquired by the source driver 110 from the timing control circuit 130) can be the data signal. In this case, the source driver 110 may directly output the source signal to the data signal terminal. Optionally, the source signal output by the timing control circuit 130 to the source driver 110 may further be the data control signal, and the data control signal is configured to control the source driver 110 to generate a corresponding data signal. In this case, the source driver 110 may generate the data signal based on the source signal and further output the generated data signal to the data signal terminal.

In the process of driving the display panel to display, the overall operation process of the pixel circuit may include a reset phase, a data writing phase, and a light emitting phase. In the reset phase, a reset signal is written to an energy storage capacitor in the pixel circuit, that is, the energy storage capacitor can be reset. In the data writing phase, the data signal is written to the energy storage capacitor. In the light emitting phase, the data signal in the energy storage capacitor can be used to conduct the driving transistor in the pixel circuit, such that the driving transistor may drive the light emitting element to luminesce, and the display panel can display a gray scale image.

Figure 2:
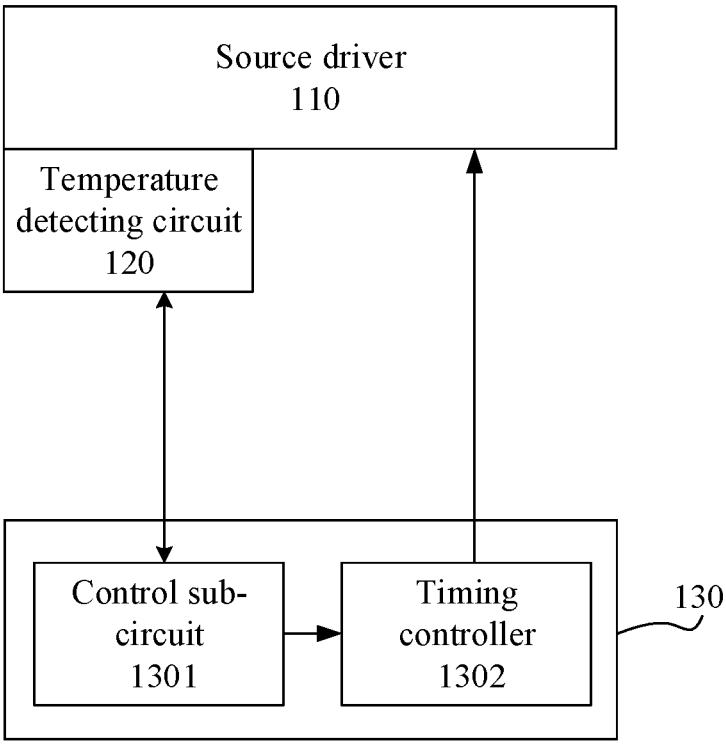
FIG. 2 is a schematic structural diagram of another display driving circuit according to an embodiment of the present disclosure.

FIG. 2 is a schematic structural diagram of another display driving circuit according to an embodiment of the present disclosure. As shown in FIG. 2, the timing control circuit 130 may include a control sub-circuit 1301 and a timing controller 1302. The control sub-circuit 1301 can be respectively connected to the temperature detecting circuit 120 and the timing controller 1302, and the timing controller 1302 may further be connected to the source driver 110.

The timing controller 1302 may store a first mapping relationship between gray scales and voltages of the source signal. The control sub-circuit 1301 can be configured to control the timing controller 1302 to output the source signal based on the first mapping relationship when the temperature of the source driver 110 is less than a temperature threshold, and to control the timing controller 1302 to output the source signal based on a second mapping relationship between the gray scales and the voltages of the source signal when the temperature of the source driver 110 is greater than or equal to the temperature threshold. Optionally, the temperature threshold can be a fixed value stored in the control sub-circuit 1301.

Each voltage of the source signal in the second mapping relationship can be determined based on a product of a corresponding voltage of the source signal in the first mapping relationship and a gain coefficient, and the gain coefficient is less than 1. For example, the gain coefficient can be 0.9.

For example, each voltage of the source signal in the second mapping relationship can be equal to the product of a corresponding voltage of the source signal in the first mapping relationship and the gain coefficient. That is, the second mapping relationship can be obtained by multiplying the gain coefficient by the first mapping relationship, the gray scale is unchanged in the obtained second mapping relationship, and merely the voltage of the source signal is changed. This approach may further be referred to as adjusting the first mapping relationship.

As the second mapping relationship is derived based on the first mapping relationship, in the embodiments of the present disclosure, the first mapping relationship can be referred to as a standard mapping relationship between the gray scales and the voltages, and the second mapping relationship can be referred to as a modified mapping relationship between the gray scales and the voltages. That is, the modified mapping relationship between the gray scales and the voltages is obtained by multiplying the standard mapping relationship between the gray scales and the voltages by the gain coefficient less than 1.

In the embodiments of the present disclosure, the standard mapping relationship between the gray scales and the voltages can be used to determine the voltage of the source signal corresponding to the gray scale when the temperature of the source driver 110 is less than (i.e., below) the temperature threshold, and the temperature of less than the temperature threshold can be considered to be a normal state. The modified mapping relationship between the gray scales and the voltages can be used to determine the voltage of the source signal corresponding to the gray scale when the temperature of the source driver 110 is greater than or equal to (i.e., above or equal to) the temperature threshold. In the case of displaying the same gray scale, the modified voltage of the source signal is less than the voltage of the source signal before being modified. That is, the voltage, determined according to the modified mapping relationship between the gray scales and the voltages, of the source signal corresponding to a certain display gray scale is generally less than a voltage of a conventional source signal, and the voltage of the conventional source signal is the voltage of the source signal corresponding to the display gray scale in the standard mapping relationship between the gray scales and the voltages. In other words, the modified source signal output by the timing controller 1302 to the source driver 110 is the source signal determined according to the modified mapping relationship between the gray scales and the voltages. The source signal before being modified output by the timing controller 1302 to the source driver 110 is the source signal determined according to the standard mapping relationship between the gray scales and the voltages.

In combination with the above embodiments, the first mapping relationship and the second mapping relationship can be used for the timing controller 1302 to determine the voltage of the source signal based on the gray scale to be displayed by the display panel.

In the case that the display panel is a liquid crystal display panel included in the liquid crystal display device, the voltage of the source signal may affect an intensity of an electric field loaded on both sides of a liquid crystal cell, thereby affecting a deflection angle of a liquid crystal molecule in the liquid crystal cell and achieving control of a luminance of the pixel. in the case that the display panel is an organic light-emitting-diode (OLED) display panel included in an OLED display device, the voltage of the source signal may affect a magnitude of a drive current output to the OLED, so as to achieve control of the luminance of the pixel. Thereby, display can be achieved.

It should be noted that by outputting the source signal according to the standard mapping relationship between the gray scales and the voltages when the temperature of the source driver 110 is less than the temperature threshold, the display effect of the display panel can be guaranteed, furthermore, the source driver 110 can avoid being damaged by high temperature.

As an optional implementation, the timing controller 1302 described in the embodiments of the present disclosure may further store the second mapping relationship. That is, the timing controller 140 includes the standard mapping relationship between the gray scales and the voltages and the modified mapping relationship between the gray scales and the voltages.

For example, a plurality of second mapping relationships may generally be stored in the timing controller 1302, and different second mapping relationships can be obtained based on different gain coefficients. For example, the gain coefficient can be 0.9, 0.8, 0.7, 0.6, 0.5, 0.4, or 0.3.

On this basis, the control sub-circuit 1301 may control the timing controller 1302 to output the source signal based on one of the plurality of second mapping relationships when the temperature of the source driver 110 is greater than or equal to the temperature threshold, that is, determine the voltage of the source signal based on the second mapping relationship. As such, the efficiency of the output source signal can be improved.

As another optional implementation, the timing controller 1302 may further store the gain coefficient. In this case, the control sub-circuit 1301 may further be configured to adjust the voltages of the source signal in the first mapping relationship based on the gain coefficient to obtain the second mapping when the temperature of the source driver 110 is greater than or equal to the temperature threshold. That is, the timing controller 1302 may store the first mapping relationship and the gain coefficient, when displaying, the second mapping relationship may be obtained in real time by calculating the first mapping relationship and the gain coefficient. In addition, the timing controller 1302 may further store a plurality of gain coefficients for calculation to obtain a plurality of different second mapping relationships. For example, the gain coefficient may include 0.9, 0.8, 0.7, 0.6, 0.5, 0.4, 0.3, or the like.

Optionally, when the timing controller 1302 output the source signal based on the second mapping relationship when the temperature of the source driver 110 is greater than or equal to the temperature threshold, the control timing controller 1302 can be first controlled to output the source signal based on a second mapping relationship corresponding to a greater gain coefficient. In this process, the temperature of the source driver 110 may continue to be detected by the temperature detecting circuit 120, and in the case that the temperature of the source driver 110 is still greater than or equal to the temperature threshold upon outputting the source signal based on the second mapping relationship obtained by the greater gain coefficient, the timing controller 1302 can be re-controlled to output the source signal based on a second mapping relationship corresponding to a less gain coefficient relative to the greater gain coefficient. That is, when the voltage of the source signal is determined based on the modified mapping relationship between the gray scales and the voltages when the temperature of the source driver 110 is greater than or equal to the temperature threshold, the source signal can be first output based on the modified mapping relationship between the gray scales and the voltages corresponding to the greater gain coefficient. In this process, the temperature of the source driver 110 may continue to be detected, in the case that the temperature of the source driver 110 is still greater than or equal to the temperature threshold, the gain coefficient is decreased to obtain the modified mapping relationship between the gray scales and the voltages corresponding to the less gain coefficient relative to the greater gain coefficient, and the source signal is output based on the modified mapping relationship between the gray scales and the voltages corresponding to the less gain coefficient relative to the greater gain coefficient.

For example, assuming that the timing controller 1302 stores a second mapping relationship based on the greater gain coefficient 0.9, and another second mapping relationship based on a less gain coefficient 0.8, that is, the greater gain coefficient is 0.9 and the less gain coefficient is 0.8. On this basis, when the temperature of the source driver 110 is greater than or equal to the temperature threshold, the timing controller 1302 can be first controlled to output the source signal based on a second mapping relationship obtained by the greater gain coefficient 0.9, that is, output the source signal based on a 0.9 times first mapping relationship. Then, the temperature of the source driver 110 may continue to be detected, and when the temperature of the source driver 110 is still greater than or equal to the temperature threshold, the timing controller 1302 can be controlled to output the source signal based on a second mapping relationship obtained by the less gain coefficient 0.8. That is, the gain coefficient can be reduced to 0.8 to obtain a 0.8 times first mapping relationship, and the source signal is output based on the 0.8 times first mapping relationship.

It should be noted that the greater gain coefficient and the less gain coefficient are relative, the greater gain coefficient is greater than the less gain coefficient, the greater gain coefficient is not limited to 0.9, and the less gain coefficient is not limited to 0.8.

Figure 3:
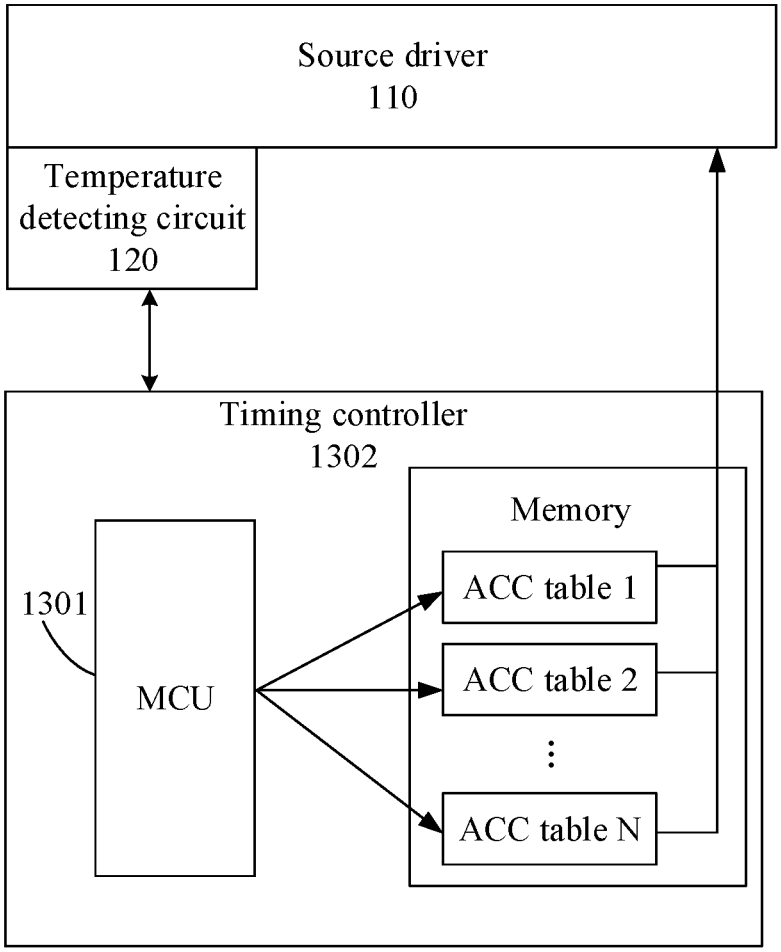
FIG. 3 is a schematic structural diagram of still another display driving circuit according to an embodiment of the present disclosure.

Optionally, referring to FIG. 3, the timing controller 1302 may include a memory, and the first mapping relationship, the second mapping relationship, the gain coefficient, and other data can be stored in the memory.

For example, the first mapping relationship and the second mapping relationship can be stored in the timing controller 1302 in a form of an ACC table shown in FIG. 3. Optionally, the first mapping relationship and the second mapping relationship may further be stored in the timing controller 1302 in a form of a function. In FIG. 3, ACC table 1 may refer to the first mapping relationship, ACC table 2 to ACC table N may refer to the plurality of second mapping relationships.

For example, a storage form of a table is taken as an example, referring to Table 1, which shows a first mapping relationship, and Table 2 shows a second mapping relationship based on a product of the first mapping relationship shown in Table 1 and the gain coefficient 0.9. That is, the voltage of the source signal shown in Table 2 is obtained by multiplying the voltage of the source signal shown in Table 1 by 0.9 and then rounding.

TABLE 1

| GRAY | R0 | G0 | B0 |
|---|---|---|---|
| 0 | 0 | 0 | 0 |
| 4 | 6 | 6 | 6 |
| 8 | 12 | 12 | 12 |
| 12 | 18 | 18 | 18 |
| 16 | 24 | 24 | 24 |
| 20 | 30 | 30 | 30 |
| 24 | 36 | 36 | 36 |
| 28 | 43 | 43 | 42 |
| 32 | 50 | 50 | 48 |
| 36 | 57 | 57 | 54 |
| 40 | 64 | 64 | 61 |
| 44 | 80 | 80 | 79 |
| 48 | 96 | 97 | 97 |
| 52 | 114 | 115 | 117 |
| 56 | 133 | 134 | 137 |
| . . . | . . . | . . . | . . . |
| 1016 | 4043 | 4030 | 4054 |
| 1020 | 4080 | 4064 | 4080 |

TABLE 2

| GRAY | R0 | G0 | B0 |
|---|---|---|---|
| 0 | 0 | 0 | 0 |
| 4 | 6 | 6 | 6 |
| 8 | 11 | 11 | 11 |
| 12 | 16 | 16 | 16 |
| 16 | 22 | 22 | 22 |
| 20 | 27 | 27 | 27 |
| 24 | 32 | 32 | 32 |
| 28 | 39 | 39 | 39 |
| 32 | 45 | 45 | 43 |
| 36 | 51 | 51 | 48 |
| 40 | 58 | 58 | 55 |
| 44 | 72 | 72 | 71 |
| 48 | 86 | 87 | 87 |
| 52 | 103 | 103 | 105 |
| 56 | 120 | 120 | 123 |
| . . . | . . . | . . . | . . . |
| 1016 | 3639 | 3627 | 3649 |
| 1020 | 3672 | 3658 | 3672 |

It should be noted that in Tables 1 and 2 above, GRAY refers to the gray scale. RO refers to the voltage of the source signal in the case of driving a red pixel to luminesce; GO refers to the voltage of the source signal in the case of driving a green pixel to luminesce; BO is the voltage of the source signal to luminesce driving a blue pixel to luminesce. Of course, in some embodiments, the display panel is not limited to only including the red pixel, the green pixel, and the blue pixel. For example, a white pixel may further be included.

Optionally, the control sub-circuit 1301 may further be configured to control the timing controller 1302 to continuously output the source signal based on the second mapping relationship during a target time period when the temperature of the source driver 110 is greater than or equal to the temperature threshold. That is, when the control sub-circuit 1301 controls the timing controller 1302 to output the source signal based on the second mapping relationship, the timing controller 1302 can be controlled to continuously output the source signal based on the second mapping relationship during the target time period. For example, the target time period can be 30 seconds.

By controlling the timing controller 1302 to continuously output the source signal by the control sub-circuit 1301 during the target time period based on the second mapping relationship, the stability of when the display panel displays images can be guaranteed, thereby avoiding the flashing phenomenon of the display panel.

Optionally, a determination of whether to switch the mapping relationship between the gray scales and the voltages can be determined in real time according to the temperature of the source driver 110 which is detected by the temperature detecting circuit 120 in real time in the process of displaying of the display panel, and the mapping relationship between the gray scales and the voltages includes the first mapping relationship and the second mapping relationship. That is, in the embodiments of the present disclosure, the control sub-circuit 1301 may further be configured to determine a target mapping relationship, based on which the timing controller outputs the source signal when an image of a second frame is displayed, in the process of displaying an image of a first frame. In other words, because the timing requirement is high when the display panel displaying, the mapping relationship between the gray scales and the voltages of the image of the second frame can be determined when the image of the first frame is displayed. Here, the target mapping relationship is any one of the first mapping relationship and the second mapping relationship, the first frame and the second frame are adjacent, and the first frame precedes the second frame.

Figure 4:
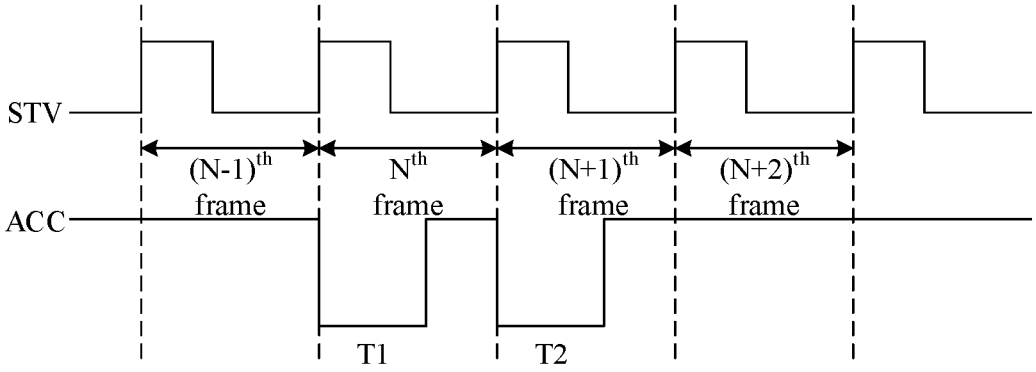
FIG. 4 is a timing diagram of a mapping relationship between a gray scale and a voltage according to an embodiment of the present disclosure.

For example, referring now to FIG. 4, a timing diagram is shown. Here, a STV signal in a pulse form is a driving signal output by the source driver 110 required by the source signal to respond, and one cycle of the STV signal is one frame, and the ACC signal is the mapping relationship between the gray scales and the voltages (including the first mapping relationship and the second mapping relationship). It can be seen that with reference to FIG. 4, when an $(N-1)^{th}$ frame image is displayed, the mapping relationship between the gray scales and the voltages on which the timing controller 1302 is based can be predetermine when an $N^{th}$ frame image is displayed.

In addition, a trigger level of the STV signal can be acted as a trigger signal to load the mapping relationship between the gray scales and the voltages of the next frame image, such that the number of control signals can be saved by acting the trigger level of the previous frame (which can be referred to as the first frame) as the trigger signal of the mapping relationship between the gray scales and the voltages of the adjacent next frame image (which can be referred to as the second frame). For example, the mapping relationship between the gray scales and the voltages in the case of displaying the an $(N+1)^{th}$ frame image can be loaded at a T1 period, and the mapping relationship between the gray scales and the voltages in the case of displaying the an $(N+2)^{th}$ frame image can be loaded at a T2 period.

Optionally, in the embodiments of the present disclosure, referring to FIG. 3, the control sub-circuit 1301 can be disposed within the timing controller 1302. That is, the control sub-circuit 1301 can be packaged within the timing controller 1302. On this basis, the timing controller 1302 can be provided with a signal interface, and the temperature detecting circuit can be connected to the control sub-circuit 1301 through the signal interface.

For example, the signal interface can be a general-purpose input/output (GPIO) interface, which is connected to the control sub-circuit 1301.

Optionally, still referring to FIG. 3, the control sub-circuit 1301 described in the embodiments of the present disclosure may include a micro controller unit (MCU).

Figure 5:
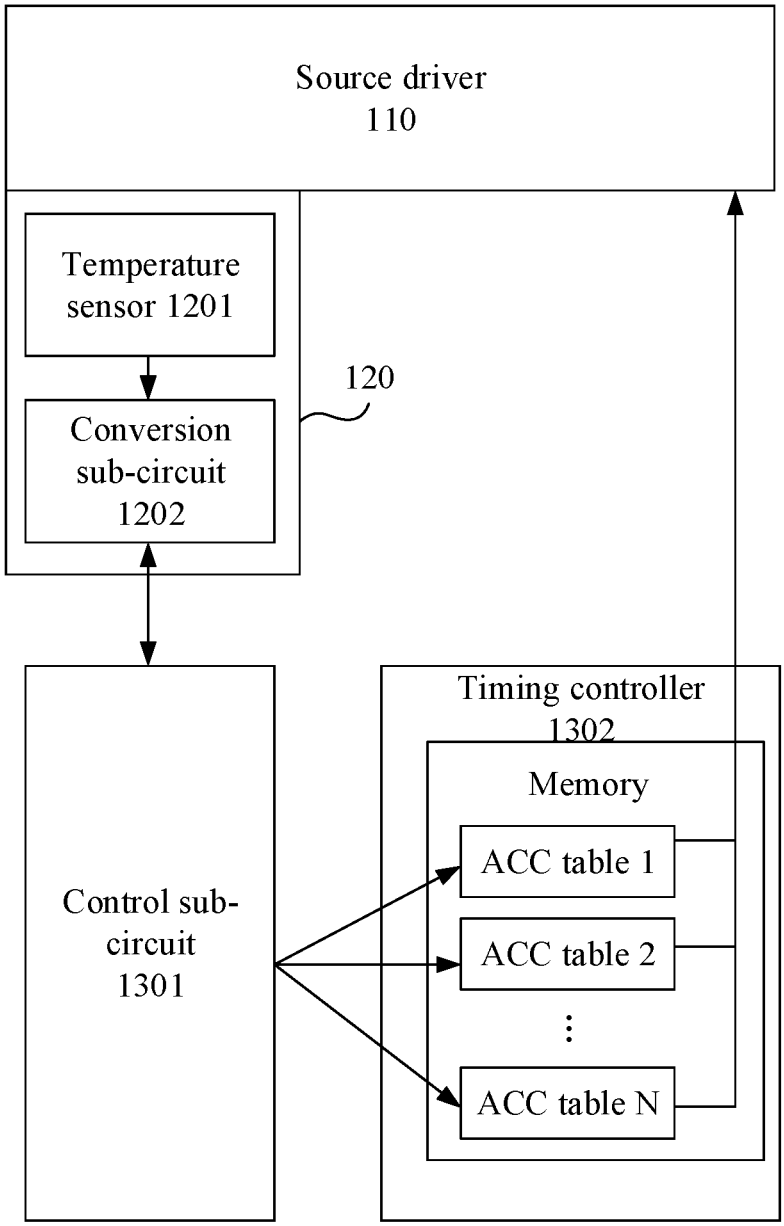
FIG. 5 is a schematic structural diagram of yet another display driving circuit according to an embodiment of the present disclosure.

FIG. 5 is a schematic structural diagram of yet another display driving circuit according to an embodiment of the present disclosure. As shown in FIG. 5, the temperature detecting circuit 120 may include a temperature sensor 1201 and a conversion sub-circuit 1202. The conversion sub-circuit 1202 can be respectively connected to the temperature sensor 1201 and the control sub-circuit 1301.

The temperature sensor 1201 can be configured to detect the temperature of the source driver 110.

The conversion sub-circuit 1202 can be configured to output a first signal to the control sub-circuit 1301 when the temperature of the source driver 110 is greater than or equal to the temperature threshold, and to output a second signal to the control sub-circuit 1301 when the temperature of the source driver 110 is less than the temperature threshold.

The control sub-circuit 1202 may, in response to the first signal, control the timing controller 1203 to output the source signal based on the second mapping relationship; and the control sub-circuit 1202 may, in response to the second signal, control the timing controller 1203 to output the source signal based on the first mapping relationship. That is, the control sub-circuit 1202 may, upon receiving the first signal, determine that the temperature of the source driver 110 is greater than or equal to the temperature threshold, and may determine, upon receiving the second signal, that the temperature of the source driver 110 is less than the temperature threshold.

Figure 6:
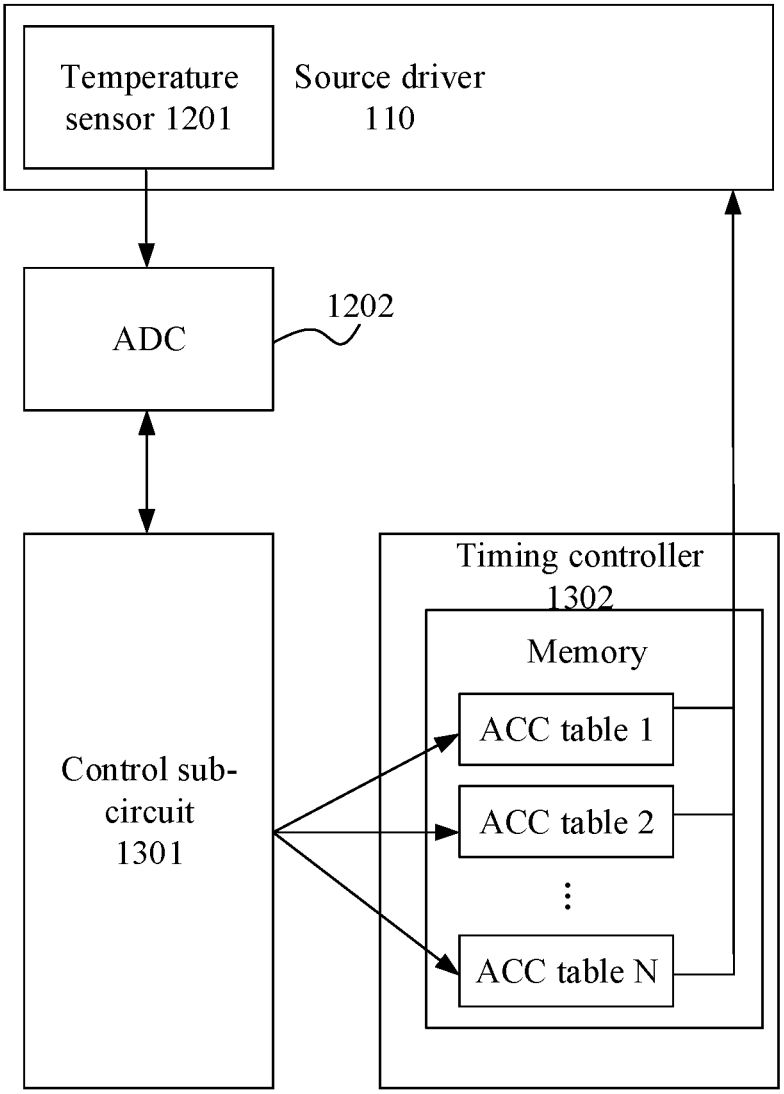
FIG. 6 is a schematic structural diagram of further another display driving circuit according to an embodiment of the present disclosure.

Optionally, referring to the structure of another display driving circuit shown in FIG. 6, the conversion sub-circuit 1202 can be an analog to digital converter (ADC). The temperature sensor 1201 may convert the detected temperature signal into an electrical signal and output the electrical signal to the conversion sub-circuit 1202, and the electrical signal is generally an analog signal. The analog to digital converter (ADC) may convert the electrical signal from an analog signal to a digital signal and output the digital signal to the control sub-circuit 1301.

It should be noted that a current of the electrical signal output by the temperature sensor 1201 can be positively related to the temperature of the source driver 110. That is, in the case that the temperature of the source driver 110 is greater, the current of the electrical signal output by the temperature sensor 1201 is greater; conversely, in the case that the temperature of the source driver 110 is less, the current of the electrical signal output by the temperature sensor 1201 is less. In other words, when the temperature of the source driver 110 is greater than or equal to the temperature threshold, the current of the electrical signal output by the temperature sensor 1201 is generally greater than or equal to a current threshold. When the temperature of the source driver 110 is less than the temperature threshold, the current of the electrical signal output by the temperature sensor 1201 is generally less than the current threshold. The analog to digital converter ADC may output a high level signal to the control sub-circuit 1301 when the current of the electrical signal output by the temperature sensor 1201 is greater than or equal to the current threshold. The analog-to-digital converter ADC may output a low-level signal to the control sub-circuit 1301 when the current of the electrical signal output by the temperature sensor 1201 is less than the current threshold. That is, the first signal described in above the embodiments can be a high level signal relative to the second signal.

As an optional implementation, as shown in FIG. 5, the temperature sensor 1201 can be disposed on a surface of the package housing, and the package housing is configured to package the source driver 110.

As another optional implementation, as shown in FIG. 6, temperature sensor 1201 can be packaged within the source driver 110. In this case, the source driver 110 can be provided with a temperature signal pin, and both the temperature sensor 1201 and the control sub-circuit 1301 can be connected to the temperature signal pin. That is, the temperature signal pin can be connected to the temperature sensor 1201, and the control sub-circuit 1301 can be connected to the temperature signal pin.

In addition, the temperature detecting circuit 120 described in the present disclosure may include a plurality of temperature sensors 1201, and the plurality of temperature sensors 1201 can be distributed in different positions. As such, the reliable detection of the temperature of the source driver 110 can be achieved.

The display driving circuit provided in the embodiments of the present disclosure may further include a gate driver circuit, and the gate driver circuit can be respectively connected to the timing controller 1302 and a gate line connected to the pixel circuit.

The timing controller 1302 may further be configured to output a drive signal to the gate driving circuit, so as to control the gate driving circuit to output a gate control signal to the gate line based on the drive signal.

Optionally, a heat dissipation assembly may further be disposed on the source driver 110 to dissipate heat for the source driver 110, further preventing the source driver 110 from being damaged due to overheating.

For example, the heat dissipation assembly may include a heat conduction strip, and the source driver 110 can be disposed on a side of a main board. That is, the source driver 110 can be disposed on the main board, and the heat conduction strip can be disposed on a side, distal from the main board, of the source driver 110.

Optionally, an active heat dissipation component (such as a fan or a water cooling device), may further be disposed in the display device, and the heat conduction strip may extend from the source driver 110 to the active heat dissipation component to conduct the heat of the source driver 110 based on the heat dissipation function of the heat dissipation component, thereby reducing the temperature of the source driver 110.

In summary, the embodiments of the present disclosure provide a display driving circuit. In the display driving circuit, the timing control circuit can output the source signal to the source driver based on the temperature of the source driver detected by the temperature detecting circuit, and the voltage of the output source signal is negatively related to the temperature of the source driver. As the temperature of the source driver is positively related to the voltage of the source signal output by the timing control circuit 130, by setting the timing control circuit to output the source signal with a less voltage to the source driver when the temperature of the source driver is greater, the temperature of the source driver can be reduced. As such, the problem of the source driver being damaged by high temperature can be solved.

Figure 7:
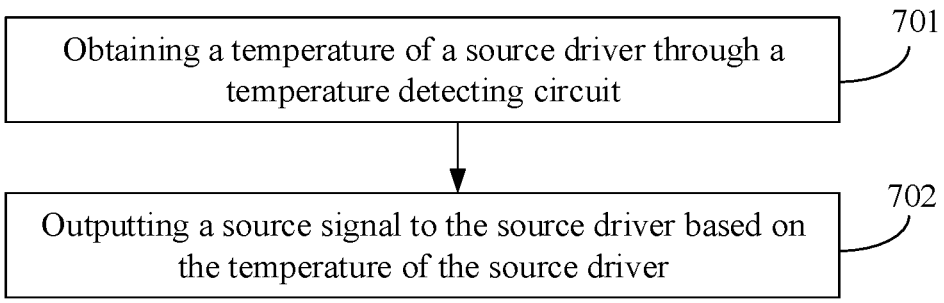
FIG. 7 is a flow chart showing a method for driving a timing control circuit according to an embodiment of the present disclosure.

FIG. 7 is a flow chart showing a method for driving a timing control circuit according to an embodiment of the present disclosure, and the method can be applicable to the timing control circuit 130 described in the above embodiments. As shown in FIG. 7, the method includes the following steps.

In 701, a temperature of a source driver is obtained through a temperature detecting circuit.

In 702, a source signal is output to the source driver based on the temperature of the source driver.

Here, a magnitude of a voltage of the source signal is negatively related to the temperature of the source driver.

Figure 8:
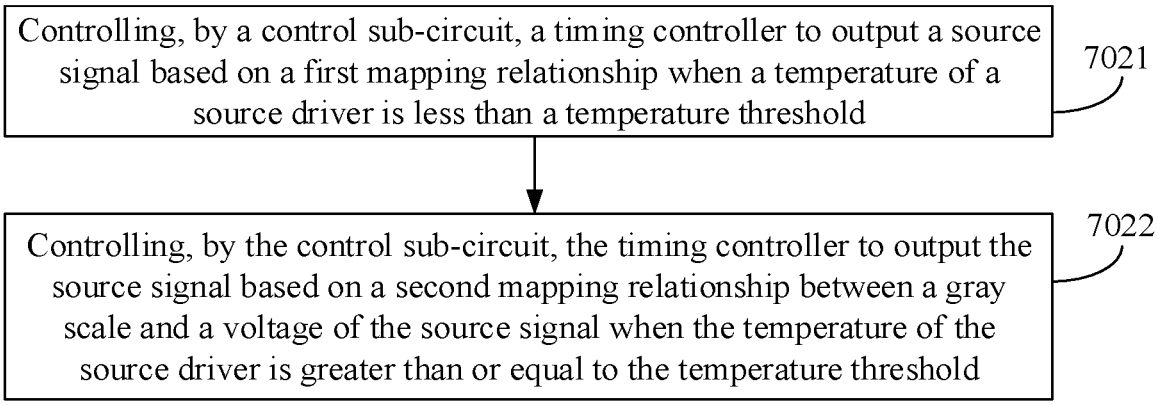
FIG. 8 is a flow chart showing a method for adjusting a source signal based on a temperature of a source driver according to an embodiment of the present disclosure.

Optionally, as shown in FIG. 2, the timing control circuit 130 may include a control sub-circuit 1301 and a timing controller 1302. The timing controller 1302 may store a first mapping relationship between gray scales and voltages of the source signal. On this basis, as shown in FIG. 8, step 702 may include the following steps.

In 7021, a control sub-circuit controls a timing controller to output a source signal through based on a first mapping relationship when a temperature of a source driver is less than a temperature threshold.

In 7022, the control sub-circuit controls the timing controller to output the source signal based on a second mapping relationship between a gray scale and a voltage of the source signal when the temperature of the source driver is greater than or equal to the temperature threshold.

Here, each voltage of the source signal in the second mapping relationship is determined based on a product of a corresponding voltage of the source signal in the first mapping relationship and a gain coefficient, the gain coefficient being less than 1.

For example, each voltage of the source signal in the second mapping relationship can be equal to the product of a corresponding voltage of the source signal in the first mapping relationship and the gain coefficient.

As an optional implementation, the timing controller further stores the second mapping relationship.

As another optional implementation, the timing controller further stores the gain coefficient. As such, before controlling the timing controller to output the source signal by the control sub-circuit based on the second mapping relationship between the gray scales and the voltages of the source signal, the method may further include adjusting, by the control sub-circuit, the voltage of the source signal in the first mapping relationship based on the gain coefficient to obtain the second mapping relationship.

Optionally, the driving method may further include determine a target mapping relationship, based on which the timing controller outputs the source signal when an image of a second frame is displayed, by the control sub-circuit in the process of displaying an image of a first frame. The target mapping relationship is any of the first mapping relationship and the second mapping relationship, the first frame and the second frame are adjacent, and the first frame precedes the second frame.

Optionally, the driving method may further include controlling, by the control sub-circuit, the timing controller to continuously output the source signal based on the second mapping relationship during a target time period when the temperature of the source driver is greater than or equal to the temperature threshold.

It should be noted that implementations of the above steps can be described with reference to the embodiments of the device part, which is not repeated in the method part.

In summary, the embodiments of the present disclosure provide a method for driving a timing control circuit. In the method, the timing control circuit can output the source signal to the source driver based on the temperature of the source driver detected by the temperature detecting circuit, and the voltage of the output source signal is negatively related to the temperature of the source driver. As the temperature of the source driver is positively related to the voltage of the source signal output by the timing control circuit 130, by setting the timing control circuit to output the source signal with a less voltage to the source driver when the temperature of the source driver is greater, the temperature of the source driver can be reduced. As such, the problem of the source driver being damaged by high temperature can be solved.

Figure 9:
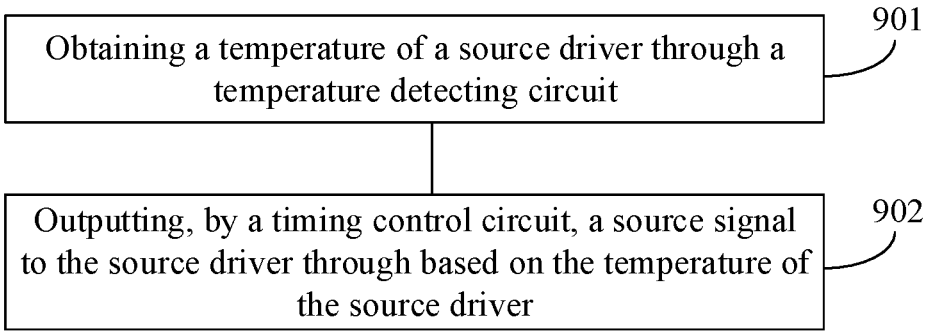
FIG. 9 is a flow chart showing a method for controlling a display driving circuit according to an embodiment of the present disclosure.

FIG. 9 is a flow chart showing a method for controlling a display driving circuit according to an embodiment of the present disclosure, which can be applicable to the display driving circuit described in any of FIG. 1 to FIG. 3, FIG. 5 and FIG. 6. As shown in FIG. 9, the method may include the following steps:

In 901, a temperature of a source driver is obtained through a temperature detecting circuit.

In 902, a timing control circuit outputs a source signal to the source driver through based on the temperature of the source driver.

The magnitude of the voltage of the source signal is negatively related to the temperature of the source driver.

Optionally, as shown in FIG. 2, the timing control circuit 130 may include a control sub-circuit 1301 and the timing controller 1302. The timing controller 1302 may store a first mapping relationship between gray scales and voltages of the source signal. On this basis, outputting the source signal, by the timing control circuit, to the source driver based on the temperature of the source driver may include:

controlling the timing controller to output the source signal by the control sub-circuit based on the first mapping relationship when the temperature of the source driver is less than a temperature threshold, and, controlling the timing controller to output the source signal by the control sub-circuit based on a second mapping relationship between the gray scales and the voltages of the source signal when the temperature of the source driver is greater than or equal to the temperature threshold.

Here, each voltage of the source signal in the second mapping relationship is determined based on a product of a corresponding voltage of the source signal in the first mapping relationship and the gain coefficient, and the gain coefficient is less than 1.

For example, each voltage of the source signal in the second mapping relationship is equal to the product of a corresponding voltage of the source signal in the first mapping relationship and the gain coefficient.

Optionally, the timing controller may further store the second mapping relationship. Optionally, the timing controller further stores the gain coefficient. When the temperature of the source driver is greater than or equal to the temperature threshold, the voltage of the source signal in the first mapping relationship can be adjusted by the control sub-circuit based on the gain coefficient to obtain the second mapping relationship.

Optionally, the control method further includes determine a target mapping relationship, based on which the timing controller outputs the source signal when an image of a second frame is displayed, by the control sub-circuit in the process of displaying an image of a first frame. And the target mapping relationship is any of the first mapping relationship and the second mapping relationship, the first frame and the second frame are adjacent, and the first frame precedes the second frame.

Optionally, the control method further includes controlling, by the control sub-circuit, the timing controller to continuously output the source signal based on the second mapping relationship during a target time period when the temperature of the source driver is greater than or equal to the temperature threshold.

Optionally, the control sub-circuit is disposed inside the timing controller. In this case, the timing controller has a signal interface, and the temperature detecting circuit is connected to the control sub-circuit through the signal interface.

Optionally, the control sub-circuit includes a micro controller unit MCU.

Optionally, as shown in FIG. 5, the temperature detecting circuit 120 may include a temperature sensor 1201 and a conversion sub-circuit 1202, and the conversion sub-circuit 1202 can be respectively connected to the temperature sensor 1201 and the control sub-circuit 1301. On this basis, obtaining the temperature of the source driver through the temperature detecting circuit may include detecting the temperature of the source driver by the temperature sensor. Then, the conversion sub-circuit can be configured to output a first signal to the control sub-circuit when the temperature of the source driver is greater than or equal to the temperature threshold, and to output a second signal to the control sub-circuit when the temperature of the source driver is less than the temperature threshold.

In combination with the above embodiments, the control sub-circuit, in response to the first signal, may control the timing controller to output the source signal based on the second mapping relationship. The control sub-circuit, in response to the second signal, may control the timing controller to output the source signal based on the first mapping relationship.

Optionally, the temperature sensor is packaged within the source driver. On this basis, the source driver has a temperature signal pin, and both the temperature sensor and the control sub-circuit are connected to the temperature signal pin. Optionally, the temperature sensor can be disposed on a surface of a package housing encapsulating the source driver.

Optionally, the conversion sub-circuit may include an analog to digital converter.

In summary, the embodiments of the present disclosure provide a method for driving a timing control circuit. In the method, the timing control circuit can output the source signal to the source driver based on the temperature of the source driver detected by the temperature detecting circuit, and the voltage of the output source signal is negatively related to the temperature of the source driver. As the temperature of the source driver is positively related to the voltage of the source signal output by the timing control circuit 130, by setting the timing control circuit to output the source signal with a less voltage to the source driver when the temperature of the source driver is greater, the temperature of the source driver can be reduced. As such, the problem of the source driver being damaged by high temperature can be solved.

Figure 10:
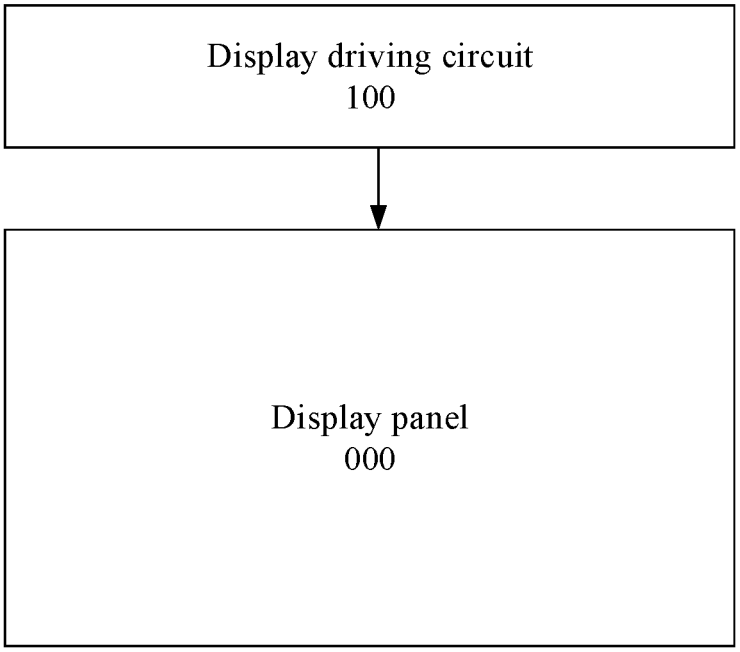
FIG. 10 is a schematic structural diagram of a display device according to an embodiment of the present disclosure.

FIG. 10 is a schematic structural diagram of a display device according to an embodiment of the present disclosure. As shown in FIG. 10, the display device may include a display panel 000, and the display driving circuit 100 as described in any of FIG. 1 to FIG. 3, FIG. 5, and FIG. 6.

The display driving circuit 100 can be connected to the display panel 000, and is configured to drive the display panel 000 to display.

For example, referring to FIG. 2, the display driving circuit may include a source driver 110, a temperature detecting circuit 120, a control sub-circuit 1301, and a timing controller 1302. The temperature detecting circuit 120 is configured to detect a temperature of the source driver 110. The control sub-circuit 1301 and the temperature detecting circuit 120 are connected to obtain the temperature of the source driver 110. The timing controller 1302 is respectively connected to the control sub-circuit 1301 and the source driver 110, and the timing controller 1302 stores a mapping relationship between a gray scale and a voltage of the source signal that is configured to determine the voltage of the source signal output to the source driver 110. The control sub-circuit 1301 is configured to adjust the mapping relationship between the gray scales and the voltages of the source signal of the timing controller 1302 based on the temperature of the source driver 110. As described in above embodiments, assuming that the first mapping relationship and the second mapping relationship are stored within the timing controller 1302, adjusting the mapping relationship between the gray scales and the voltages of the source signal may refer to determining whether the mapping relationship is the first mapping relationship or the second mapping relationship.

Optionally, the display device provided in the embodiments of the present disclosure can be an electronic device with a display function, such as a liquid crystal display device, an OLED display device, a television, a computer, a mobile phone, a tablet computer, a vehicle computer, an electronic reader, a navigator, or the like, in particular, can be a liquid crystal display device with great size, such as a liquid crystal television or the like.

In addition, as described in above embodiments, the display device may further include a heat dissipation assembly (e.g., a heat conduction strip) and an active heat dissipation component (e.g., a fan or a water cooling device). The heat dissipation assembly can be disposed on a side of the source driver 110, extend to the active heat dissipation component and be connected to the active heat dissipation component to cool the source driver 110.

The cooperation of the heat dissipation assembly, the active heat dissipation component, and the display driving circuit prevents the source driver from being damaged due to overheating, thereby ensuring a high yield of the display device, and a great display effect of the display panel.

Other implementations of the present disclosure will be apparent to those skilled in the art from consideration of the specification and practice of the present disclosure. The present disclosure is intended to cover any variations, uses, or adaptation changes of the present disclosure following the general principles thereof and including common knowledge or commonly used technical measures which are not disclosed herein. The specification and the embodiments are to be considered as exemplary only, and the true scope and spirit of the present disclosure are indicated by the following claims.

What is claimed is:

1. A display driving circuit, comprising: a source driver, a temperature detecting circuit, and a timing control circuit, wherein the temperature detecting circuit is connected to the timing control circuit, and is configured to detect a temperature of the source driver;

the timing control circuit comprises a control sub-circuit and a timing controller; and the timing controller stores a first mapping relationship between gray scales and voltages of a source signal;

the control sub-circuit is connected to the temperature detecting circuit and the timing controller, and the timing controller is further connected to the source driver; and the control sub-circuit is configured to control the timing controller to output the source signal to the source driver based on the first mapping relationship when the temperature of the source driver is less than a temperature threshold, and to control the timing controller to output the source signal to the source driver based on a second mapping relationship between the gray scales and the voltages of the source signal when the temperature of the source driver is greater than or equal to the temperature threshold;

wherein each voltage of the source signal in the second mapping relationship is determined based on a product of a corresponding voltage of the source signal in the first mapping relationship and a gain coefficient, the gain coefficient being less than 1, and a magnitude of the voltage of the source signal is negatively related to the temperature of the source driver.

2. The display driving circuit according to claim 1, wherein each voltage of the source signal in the second mapping relationship is equal to the product of a corresponding voltage of the source signal in the first mapping relationship and the gain coefficient.

3. The display driving circuit according to claim 1, wherein the timing controller further stores the second mapping relationship.

4. The display driving circuit according to claim 1, wherein the timing controller further stores the gain coefficient;

the control sub-circuit is further configured to adjust the voltages of the source signal in the first mapping relationship based on the gain coefficient to obtain the second mapping relationship when the temperature of the source driver is greater than or equal to the temperature threshold.

5. The display driving circuit according to claim 1, wherein the control sub-circuit is further configured to:

determine a target mapping relationship, based on which the timing controller outputs the source signal when an image of a second frame is displayed, in a process of displaying an image of a first frame;

wherein the target mapping relationship is any of the first mapping relationship and the second mapping relationship, the first frame and the second frame are adjacent, and the first frame precedes the second frame.

6. The display driving circuit according to claim 1, wherein the control sub-circuit is further configured to control the timing controller to continuously output the source signal based on the second mapping relationship during a target time period when the temperature of the source driver is greater than or equal to the temperature threshold.

7. The display driving circuit according to claim 1, wherein the control sub-circuit is disposed inside the timing controller;

wherein the timing controller has a signal interface, and the temperature detecting circuit is connected to the control sub-circuit through the signal interface.

8. The display driving circuit according to claim 1, wherein the control sub-circuit comprises a micro controller unit (MCU).

9. The display driving circuit according to claim 1, wherein the temperature detecting circuit comprises a temperature sensor and a conversion sub-circuit, and the conversion sub-circuit is respectively connected to the temperature sensor and the control sub-circuit;

the temperature sensor is configured to detect the temperature of the source driver; and the conversion sub-circuit is configured to output a first signal to the control sub-circuit when the temperature of the source driver is greater than or equal to the temperature threshold, and output a second signal to the control sub-circuit when the temperature of the source driver is less than the temperature threshold; wherein the control sub-circuit, in response to the first signal, controls the timing controller to output the source signal based on the second mapping relationship; and the control sub-circuit, in response to the second signal, controls the timing controller to output the source signal based on the first mapping relationship.

10. The display driving circuit according to claim 9, wherein the temperature sensor is packaged within the source driver; and the source driver has a temperature signal pin, and both the temperature sensor and the control sub-circuit are connected to the temperature signal pin.

11. The display driving circuit according to claim 9, wherein the temperature sensor is disposed on a surface of a package housing, and the package housing is configured to package the source driver.

12. The display driving circuit according to claim 9, wherein the conversion sub-circuit comprises an analog to digital converter.

13. The display driving circuit according to claim 9, wherein each voltage of the source signal in the second mapping relationship is equal to the product of a corresponding voltage of the source signal in the first mapping relationship and the gain coefficient;

contents stored in the timing controller further comprise any of the following information: the second mapping relationship and the gain coefficient; and in the case that the content stored in the timing controller is the gain coefficient, the control sub-circuit is configured to adjust the voltages of the source signal in the first mapping relationship based on the gain coefficient to obtain the second mapping relationship when the temperature of the source driver is greater than or equal to the temperature threshold;

the control sub-circuit is further configured to determine a target mapping relationship, based on which the timing controller outputs the source signal when an image of a second frame is displayed, in the process of displaying an image of a first frame; wherein the target mapping relationship is any of the first mapping relationship and the second mapping relationship, the first frame and the second frame are adjacent, and the first frame precedes the second frame;

the control sub-circuit is further configured to control the timing controller to continuously output the source signal based on the second mapping relationship during a target time period when the temperature of the source driver is greater than or equal to the temperature threshold;

the control sub-circuit is disposed inside the timing controller; wherein the timing controller has a signal interface, and the temperature detecting circuit is connected to the control sub-circuit through the signal interface;

the control sub-circuit comprises a micro controller unit (MCU);

the temperature sensor is positioned in any of following ways: the temperature sensor is disposed on a surface of a package housing, and the package housing is configured to package the source driver; and, the temperature sensor is packaged within the source driver; and in the case that the temperature sensor is packaged within the source driver, the source driver has a temperature signal pin, and both the temperature sensor and the control sub-circuit are connected to the temperature signal pin; and the conversion sub-circuit comprises an analog to digital converter.

14. A method for driving a timing control circuit, wherein the timing control circuit comprises a control sub-circuit and a timing controller; the timing controller stores a first mapping relationship between gray scales and voltages of the source signal, and the method comprising:

obtaining a temperature of a source driver through a temperature detecting circuit;

controlling, by the control sub-circuit, the timing controller to output the source signal to the source driver based on the first mapping relationship when the temperature of the source driver is less than a temperature threshold; and controlling, by the control sub-circuit, the timing controller to output the source signal to the source driver based on a second mapping relationship between the gray scales and the voltages of the source signal when the temperature of the source driver is greater than or equal to the temperature threshold;

wherein each voltage of the source signal in the second mapping relationship is determined based on a product of a corresponding voltage of the source signal in the first mapping relationship and a gain coefficient, the gain coefficient being less than 1, and a magnitude of the voltage of the source signal is negatively related to the temperature of the source driver.

15. The method according to claim 14, wherein each voltage of the source signal in the second mapping relationship is equal to the product of a corresponding voltage of the source signal in the first mapping relationship and the gain coefficient.

16. The method according to claim 14, wherein the timing controller further stores the second mapping relationship.

17. The method according to claim 14, wherein the timing controller further stores the gain coefficient; before controlling the timing controller to output the source signal by the control sub-circuit based on the second mapping relationship between the gray scales and the voltages of the source signal, the method further comprises:

adjusting, by the control sub-circuit, the voltage of the source signal in the first mapping relationship based on the gain coefficient to obtain the second mapping relationship.

18. A display device, comprising a display panel and a display driving circuit, wherein the display driving circuit is connected to the display panel, and is configured to drive the display panel to display;

wherein the display driving circuit comprises a source driver, a temperature detecting circuit, and a timing control circuit;

the temperature detecting circuit is connected to the timing control circuit, and is configured to detect a temperature of the source driver;

the timing control circuit comprises a control sub-circuit and a timing controller; and the timing controller stores a first mapping relationship between gray scales and voltages of a source signal;

the control sub-circuit is connected to the temperature detecting circuit and the timing controller, and the timing controller is further connected to the source driver; and the control sub-circuit is configured to control the timing controller to output the source signal to the source driver based on the first mapping relationship when the temperature of the source driver is less than a temperature threshold, and to control the timing controller to output the source signal to the source driver based on a second mapping relationship between the gray scales and the voltages of the source signal when the temperature of the source driver is greater than or equal to the temperature threshold;

wherein each voltage of the source signal in the second mapping relationship is determined based on a product of a corresponding voltage of the source signal in the first mapping relationship and a gain coefficient, the gain coefficient being less than 1, and a magnitude of the voltage of the source signal is negatively related to the temperature of the source driver.

* * * * *